US006314969B1

(12) United States Patent
Lacause

(10) Patent No.: US 6,314,969 B1
(45) Date of Patent: Nov. 13, 2001

(54) HAIR DECORATING AND RESTRAINING DEVICE

(76) Inventor: Laura Lacause, 101-B Providence St., Millville, MA (US) 01529

( * ) Notice: Subject to any disclaimer, the term of this patent is extended or adjusted under 35 U.S.C. 154(b) by 0 days.

(21) Appl. No.: 09/616,929

(22) Filed: Jul. 14, 2000

(51) Int. Cl.[7] ..... A45D 8/36
(52) U.S. Cl. ..... 132/275
(58) Field of Search ..... 132/273, 275, 132/276, 277; 24/298, 302, 122.3, 18; 63/14.2, 23, 3, 43; D28/10, 39, 40, 41; D11/5, 8, 11

(56) References Cited

U.S. PATENT DOCUMENTS

| | | | | |
|---|---|---|---|---|
| D. 174,278 | * | 3/1955 | Katz | D11/8 |
| D. 246,293 | * | 11/1977 | Doughty | D11/4 |
| D. 254,273 | | 2/1980 | Lawrence . | |
| D. 378,903 | | 4/1997 | Feliciano . | |
| 2,142,952 | * | 1/1939 | Rathgeber | 24/18 |
| 4,993,988 | | 2/1991 | Chamberlain . | |
| 5,388,598 | | 2/1995 | Whitten . | |
| 5,404,892 | | 4/1995 | Bretl . | |
| 5,465,741 | | 11/1995 | Dvorak . | |
| 5,881,736 | * | 3/1999 | Turner et al. | 132/200 |
| 5,899,211 | * | 5/1999 | Brown | 132/201 |
| 6,206,011 | * | 3/2001 | Sartena | 132/275 |
| 6,260,559 | * | 7/2001 | Schirren et al. | 132/275 |

FOREIGN PATENT DOCUMENTS

| | | | | |
|---|---|---|---|---|
| 21379 | * | 1/1901 | (CH) | 132/273 |
| 797281 | * | 4/1936 | (FR) | 132/273 |

* cited by examiner

*Primary Examiner*—Todd E. Manahan
*Assistant Examiner*—David C. Comstock

(57) ABSTRACT

A hair decorating device for decorating and restraining a portion of hair. The hair decorating device includes a flexible member. The flexible member is elongate and has a first end and a second end. A coupling assembly removably couples the flexible member to the hair of a user. The coupling assembly includes a securing member. The securing member is removably securable to the hair of the user. A fastening means fastens the securing member to the first end of the elongate member. The fastening means is coupled to the securing member. A filament, which is elongate, is tightly wrapped about the fastening means and the elongate member such that fastening means is coupled to the elongate member. The second end of the elongate member generally is bulbous.

12 Claims, 2 Drawing Sheets

FIG 1
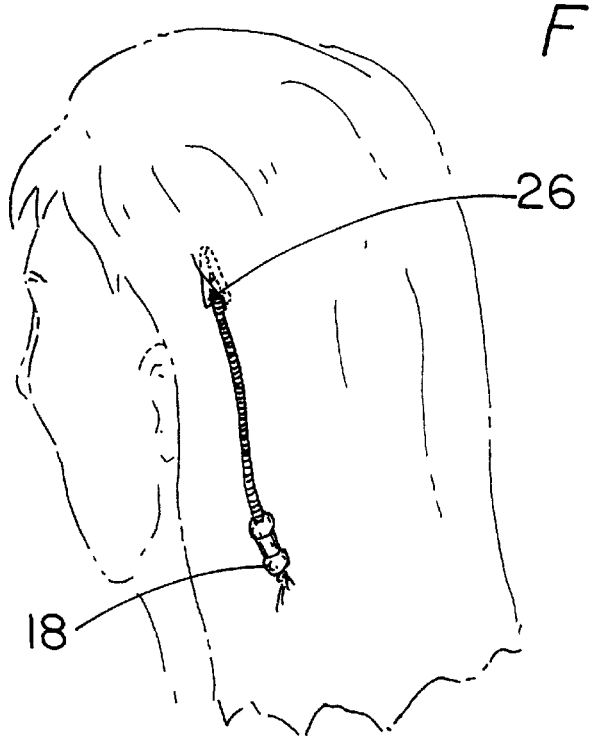
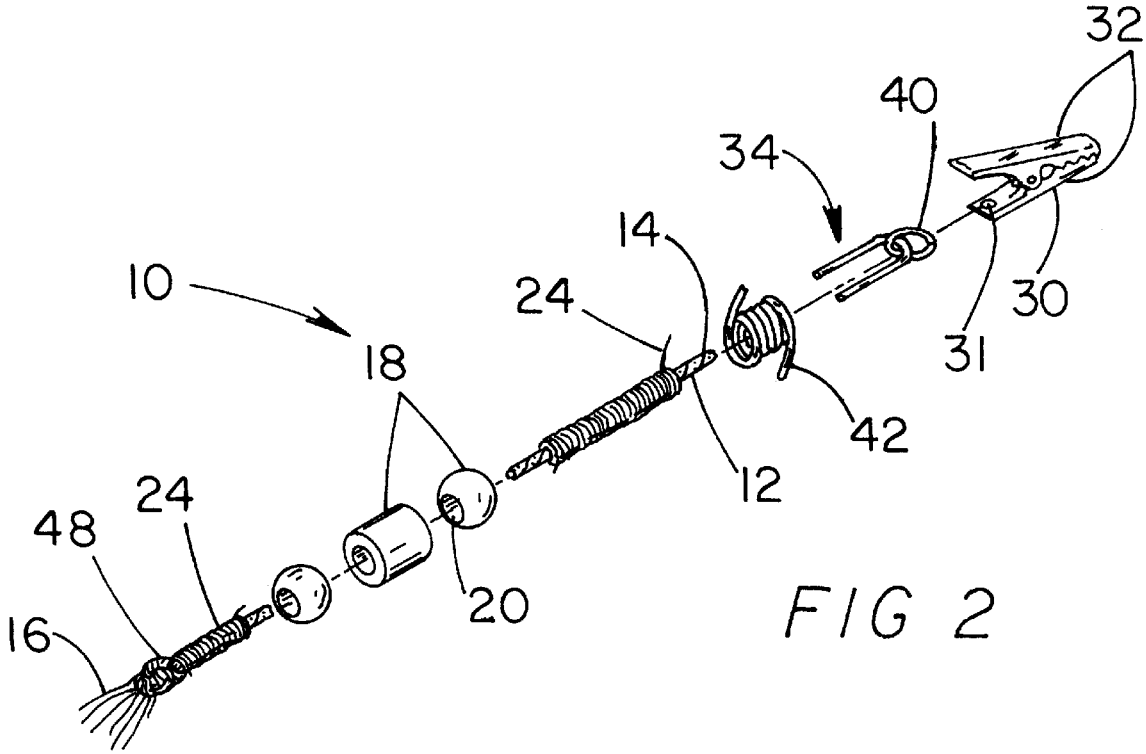
FIG 2

HAIR DECORATING AND RESTRAINING DEVICE

BACKGROUND OF THE INVENTION

1. Field of the Invention

The present invention relates to decorating devices for hair and more particularly pertains to a new hair decorating device for decorating and restraining a portion of hair.

2. Description of the Prior Art

The use of decorating devices for hair is known in the prior art. More specifically, decorating devices for hair heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,404,892; 5,465,741; 5,388,598; 4,993,988; U.S. Pat. Nos. 378,903; and 254,273.

While these devices fulfill their respective, particular objectives and requirements, the aforementioned patents do not disclose a new hair decorating device. The inventive device includes a flexible member. The flexible member is elongate and has a first end and a second end. A coupling assembly removably couples the flexible member to the hair of a user. The coupling assembly includes a securing member. The securing member is adapted for is removably securable to the hair of the user. A fastening means fastens the securing member to the first end of the elongate member. The fastening means is coupled to the securing member. A filament, which is elongate, is tightly wrapped about the fastening means and the elongate member such that fastening means is coupled to the elongate member. The second end of the elongate member generally is bulbous.

In these respects, the hair decorating device according to the present invention substantially departs from the conventional concepts and designs of the prior art, and in so doing provides an apparatus primarily developed for the purpose of decorating and restraining a portion of hair.

SUMMARY OF THE INVENTION

In view of the foregoing disadvantages inherent in the known types of decorating devices for hair now present in the prior art, the present invention provides a new hair decorating device construction wherein the same can be utilized for decorating and restraining a portion of hair.

The general purpose of the present invention, which will be described subsequently in greater detail, is to provide a new hair decorating device apparatus and method which has many of the advantages of the decorating devices for hair mentioned heretofore and many novel features that result in a new hair decorating device which is not anticipated, rendered obvious, suggested, or even implied by any of the prior art decorating devices for hair, either alone or in any combination thereof.

To attain this, the present invention generally comprises a flexible member. The flexible member is elongate and has a first end and a second end. A coupling assembly removably couples the flexible member to the hair of a user. The coupling assembly includes a securing member. The securing member is adapted for is removably securable to the hair of the user. A fastening means fastens the securing member to the first end of the elongate member. The fastening means is coupled to the securing member. A filament, which is elongate, is tightly wrapped about the fastening means and the elongate member such that fastening means is coupled to the elongate member. The second end of the elongate member generally is bulbous.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair decorating device apparatus and method which has many of the advantages of the decorating devices for hair mentioned heretofore and many novel features that result in a new hair decorating device which is not anticipated, rendered obvious, suggested, or even implied by any of the prior art decorating devices for hair, either alone or in any combination thereof.

It is another object of the present invention to provide a new hair decorating device which may be easily and efficiently manufactured and marketed.

It is a further object of the present invention to provide a new hair decorating device which is of a durable and reliable construction.

An even further object of the present invention is to provide a new hair decorating device which is susceptible of a low cost of manufacture with regard to both materials and labor, and which accordingly is then susceptible of low prices of sale to the consuming public, thereby making such hair decorating device economically available to the buying public.

Still yet another object of the present invention is to provide a new hair decorating device which provides in the apparatuses and methods of the prior art some of the advantages thereof, while simultaneously overcoming some of the disadvantages normally associated therewith.

Still another object of the present invention is to provide a new hair decorating device for decorating and restraining a portion of hair.

Yet another object of the present invention is to provide a new hair decorating device which includes a flexible member. The flexible member is elongate and has a first end and a second end. A coupling assembly removably couples the flexible member to the hair of a user. The coupling assembly includes a securing member. The securing member is adapted for is removably securable to the hair of the user. A fastening means fastens the securing member to the first end of the elongate member. The fastening means is coupled to the securing member. A filament, which is elongate, is tightly wrapped about the fastening means and the elongate member such that fastening means is coupled to the elongate member. The second end of the elongate member generally is bulbous.

Still yet another object of the present invention is to provide a new hair decorating device that has interchangeable beads and colored threads such that the device will match the apparel of the user.

Even still another object of the present invention is to provide a new hair decorating device that has attachments which may be added thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new hair decorating device in use according to the present invention.

FIG. 2 is a schematic perspective view of the present invention.

DESCRIPTION OF THE PREFERRED EMBODIMENT

Figure 3:
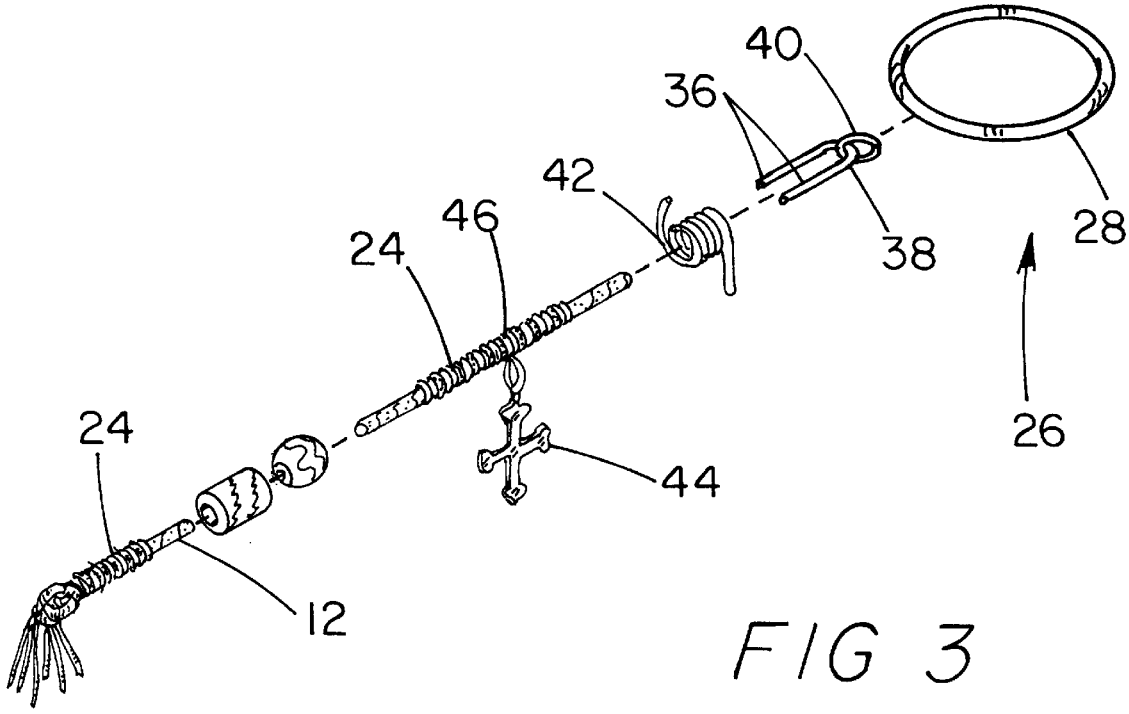
FIG. 3 is a schematic perspective view of the present invention.

With reference now to the drawings, and in particular to FIGS. 1 through 3 thereof, a new hair decorating device embodying the principles and concepts of the present invention and generally designated by the reference numeral 10 will be described.

As best illustrated in FIGS. 1 through 3, the hair decorating device 10 generally comprises a flexible member 12 and coupling assembly for coupling the flexible member 12 to the hair of the user. The flexible member 12 is elongate and has a first end 14 and a second end 16.

A plurality of beads 18 each has an aperture 20 therein. The flexible member 12 may be extended through the apertures 20 in the beads 18. The beads 18 are of the conventional type ornamental beads 18.

A plurality of elongate fibers 24 is each wrapped about the flexible member 12 such that portions of the flexible member 12 are substantially covered by the fibers 24. The fibers 24 may come in multiple colors and generally comprise conventional thread.

The coupling assembly removably couples the flexible member 12 to the hair of a user. The coupling assembly includes a securing member 26. The securing member 26 is adapted for being removably securable to the hair of the user. The securing member may comprise an elastic loop 28 as shown in FIG. 3. FIG. 2 shows a conventional alligator type clamp 30 having a pair of opposed jaws 32, which are biased against each other, however any conventional clamp or elastic band may be used.

A fastening means 34 fastens the securing member 26 to the first end 14 of the elongate member 12. The fastening means 34 comprises a clip. The clip has two legs 36 and a base portion 38. The clip generally is U-shaped. Ideally, a distance between the legs 36 is substantially equal to width of the elongate member 12.

An annular member 40 is positioned on the fastening means 34. The securing member 26 is extended through the annular member 40. The annular member 40 comprises a ring. The fastening means 34 is insertable through the ring. The elastic loop 28, or an aperture 31 on the clamp 30, extends through the ring.

An elongate filament 42 is tightly wrapped about the fastening means 34 and the elongate member 12 such that the base portion 38 of the coupling means 34 is generally adjacent to the first end 14 of the elongate member 12 and one of the legs 36 is positioned on either side of the elongate member 12. The elongate filament 42 may be any type of thread-like material.

A plurality of attachments 44, each having a ring 46 portion thereon, may be removably positioned on the elongate member 12. The attachments 44 may be of any type of ornamental item which may be attached to the elongate member 12. The attachments should be small and light of weight for the comfort of the wearer.

The second end 16 of the elongate member 12 generally is bulbous. Ideally, the second end 16 of the elongate member comprises a knot 48 to prevent beads or other items from sliding off of the elongate member.

In use, the loop 28 or clamp 30 is used to grab a portion of the user's hair as is shown in FIG. 1. The fibers 24, beads 18, and attachments 44 could potentially be removed so that they may be replaced with other such items as seen fit by the user, however, the fibers are knotted such that the beads and attachments are not removable and thus strengthening the integrity of the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair decorating apparatus, said apparatus comprising:

a flexible elongate member having a first end and a second end;

a coupling assembly for removably coupling said elongate member to the hair of a user, said coupling assembly comprising:

a securing member, said securing member being adapted for being removably securable to the hair of the user;

a fastening means for fastening said securing member to said first end of said elongate member, said fastening means being coupled to said securing member;

a filament, said filament being elongate, said filament being tightly wrapped about said fastening means and said elongate member such that the fastening means is coupled to said elongate member; and wherein said second end of said elongate member is generally bulbous;

said securing member comprising an elastic loop; and said fastening means comprising a clip, said clip having two legs and a base portion, said clip generally being U-shaped;

an annular member, said annular member being positioned on said fastening means, wherein said securing member is extended through said annular member, said annular member being a ring, said fastening means being insertable through said ring, said elastic loop extending through said ring.

2. The hair decorating apparatus as in claim 1, further comprising:

at least one bead, said bead having an aperture therein, wherein said flexible member may be extended through said aperture in said bead.

3. The hair decorating apparatus as in claim 2, further comprising:

a plurality of fibers, each of said fibers being elongate, each of said fibers being, wrapped about said flexible member such that portions of said flexible member are substantially covered by said threads.

4. The hair decorating apparatus as in claim 1, further comprising:

a plurality of fibers, each of said fibers being elongate, each of said fibers being wrapped about said flexible member such that portions of said flexible member are substantially covered by said threads.

5. The hair decorating apparatus as in claim 1, wherein said securing member further comprises:

clamping means for clamping to a portion of a user's hair, said clamping, means having, a pair of opposed jaws, said jaws being biased toward each other.

6. A hair decorating and restraining apparatus, said apparatus comprising:

a flexible member, said flexible member being elongate and having a first end and a second end;

a plurality of beads, each of said beads having an aperture therein, wherein said flexible member may be extended through said apertures in said beads;

a plurality of fibers, each of said fibers being elongate, each of said fibers being wrapped about said flexible member such that portions of said flexible member are substantially covered by said threads, said fibers being colored;

a coupling assembly for removably coupling said flexible member to the hair of a user, said coupling assembly comprising:

a securing member, said securing member being adapted for being removably securable to the hair of the user, said securing member comprising an elastic loop;

a fastening means for fastening said securing member to said first end of said elongate member, said fastening means comprising a clip, said clip having two legs and a base portion, said clip generally being U-shaped, a distance between said legs being substantially equal to width of said elongate member;

an annular member, said annular member being positioned on said fastening means, wherein said securing member is extended through said annular member, said annular member comprising a ring, said fastening means being insertable through said ring, said elastic loop extending through said ring;

a filament, said filament being elongate, said filament being tightly wrapped about said fastening means and said elongate member such that said base portion of said coupling means is generally adjacent to said first end of said elongate member and one of said legs is positioned on either side of said elongate member;

a plurality of attachments, said attachments each having a ring portion thereon adapted for being removably positioned on said elongate member; and wherein said second end of said elongate member generally being bulbous, said second end of said elongate member comprising a knot.

7. A hair decorating apparatus, said apparatus comprising:

a flexible elongate member having a first end and a second end, said second end of said elongate member being generally bulbous;

a coupling assembly for removably coupling said elongate member to the hair of a user, said coupling assembly comprising:

a securing member adapted for being removably securable to the hair of the user;

a fastening means for fastening said securing member to said first end of said elongate member, said fastening means being coupled to said securing member, said fastening means comprising a clip, said clip being substantially U-shaped with two legs and a base portion; and an elongate filament being tightly wrapped about said fastening means and said elongate member such that the fastening means is coupled to said elongate member; and an annular member being positioned on said clip, said securing member extending through said annular member, said clip being insertable through said annular member, said fastening member extending through said ring.

8. The hair decorating apparatus as in claim 7, further comprising:

at least one bead having an aperture therein, wherein said flexible member may be extended through said aperture in said bead.

9. The hair decorating apparatus as in claim 8, further comprising:

a plurality of fibers, each of said fibers being elongate, each of said fibers being wrapped about said flexible member such that portions of said flexible member are substantially covered by said threads.

10. The hair decorating apparatus as in claim 7, further comprising:

a plurality of fibers, each of said fibers being elongate, each of said fibers being wrapped about said flexible member such that portions of said flexible member are substantially covered by said threads.

11. The hair decorating apparatus as in claim 7, wherein said securing member further comprises:

clamping means for clamping to a portion of a user's hair, said clamping means having a pair of opposed jaws, said jaws being biased toward each other.

12. The hair decorating apparatus as in claim 7, wherein said securing member further comprises an elastic loop.

* * * * *